US005201465A

United States Patent [19]

Limehouse

[11] Patent Number: 5,201,465

[45] Date of Patent: Apr. 13, 1993

[54] MAILBOX SIGNALING DEVICE

[76] Inventor: Terry Limehouse, 103 Quarterhorse Cir., Summerville, S.C. 29483

[21] Appl. No.: 881,644

[22] Filed: May 12, 1992

[51] Int. Cl.[5] ..... B65D 91/00

[52] U.S. Cl. ..... 232/35

[58] Field of Search ..... 232/35, 34

[56] References Cited

U.S. PATENT DOCUMENTS

| | | | |
|---|---|---|---|
| 3,014,641 | 12/1961 | Sowton | 232/35 |
| 4,072,265 | 2/1978 | Jones | 232/35 |
| 4,318,507 | 3/1982 | Thopsey et al. | 232/35 |
| 4,570,846 | 2/1986 | Morgrey | 232/35 |
| 4,706,880 | 11/1987 | Peters | 232/35 |
| 4,877,180 | 10/1989 | Shull | 232/35 |
| 4,913,342 | 4/1990 | Fluck | 232/35 |
| 4,986,467 | 1/1991 | Bibbee | 232/35 |

*Primary Examiner*—Michael F. Trettel
*Assistant Examiner*—Michael J. Milano
*Attorney, Agent, or Firm*—B. Craig Killough

[57] ABSTRACT

A mailbox signaling device which indicates that a door to a mailbox has been opened for the placement of mail within the mailbox. The action of the mailbox door causes a movement of a lever which actuates a trigger to release a signal rod. A signal rod is displaced from its housing by means of spring biasing, to indicate the opening of the mailbox door.

7 Claims, 2 Drawing Sheets

MAILBOX SIGNALING DEVICE

BACKGROUND OF THE INVENTION

The present invention relates to mailboxes generally, and is more specifically directed to a signaling device which indicates that the door to the mailbox has been opened.

Mailboxes known as rural mailboxes are in widespread use. The basic design for rural mailboxes has been relatively constant for several decades.

Mailboxes known as rural mailboxes are usually mounted on a platform which extends from a supporting post. The vast majority of rural mailboxes have in common a door which is opened by pivoting the door in a downward direction toward the platform on which the mailbox is mounted. Typically, rural mailboxes are located near a street or a road, and away from a house. In order to ascertain that mail has been placed within the mailbox, it is necessary to travel to the mailbox and open the door to check for mail. On days of inclement weather, a trip to the mailbox is not a journey of pleasure. A need therefore exists for a reliable yet easy to use signaling device which will indicate that the door to the mailbox has been opened by the postal worker.

SUMMARY OF THE PRESENT INVENTION

The present invention is a signal which is automatically actuated as the door to the mailbox is opened. A signal rod which will be typically mounted so as to be visible above the top of the mailbox pops up as the door to the mailbox is opened.

As the door to the mailbox is pivoted downwardly, the door contacts a lever which is located within a platform to which the mailbox will typically be mounted. As the lever is displaced, the lever actuates a trigger which is pivotally mounted to the platform. The trigger engages a signal rod to hold the signal rod in place, but upon actuation, disengages from a slot within the signal rod, allowing the signal rod to be displaced by spring biasing. The signal rod will remain in this position indicating that the mailbox door has been opened, until it is pushed downwardly, whereupon the trigger again engages the slot within the signal rod to hold the signal rod in place, until the trigger is pivoted away from the signal rod by the opening of the mailbox door. The device could be used with any mailbox having a door action which causes the door to contact and displace the lever upon opening of the door.

DETAILED DESCRIPTION OF THE DRAWINGS

DETAILED DESCRIPTION OF THE PREFERRED EMBODIMENT

Figure 1:
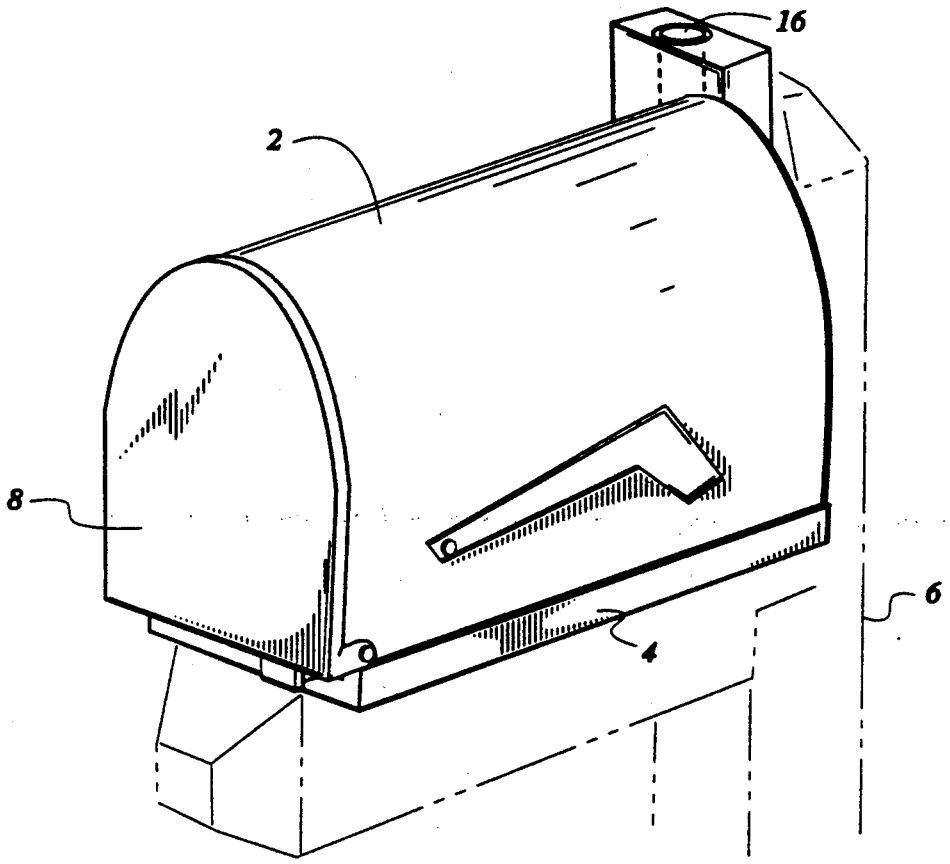
FIG. 1 is a perspective view of a rural mailbox mounted on a platform of the signalling device, with a supporting post shown as a phantom.

Rural mailboxes 2 are typically designed as shown in FIG. 1. Rural mailboxes have a generally flat bottom and are mounted to a platform 4 which is in turn mounted to a supporting post 6. The front of the mailbox has a door 8 which is capable of pivoting downward to open the mailbox so that mail may be placed within the mailbox, or removed from the mailbox. In FIG. 1, the mailbox is mounted to a platform 4 which is part of the mailbox signaling device.

Figure 2:
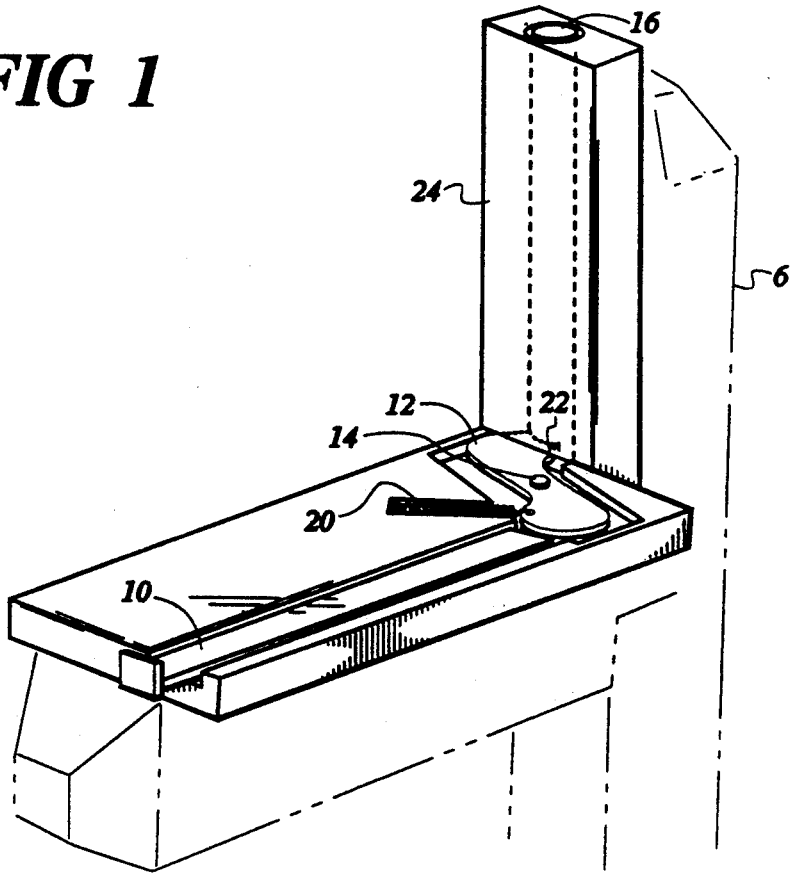
FIG. 2 is a perspective view of the mailbox signaling device, with the device mounted to a post which is shown as a phantom.

The mailbox signaling device is shown in perspective in FIG. 2. A lever 10 is present within a slot which is formed within the platform. This lever is capable of sliding within the slot, so that as the lever is actuated by the pivoting of the mailbox door, the lever strikes a trigger 12.

The trigger 12 is mounted within a recess formed within the platform by a pin or axle 14 which allows the trigger to pivot. One end of the trigger engages the signal rod 16 by means of a slot 22 which is formed within the signal rod.

Figure 4:
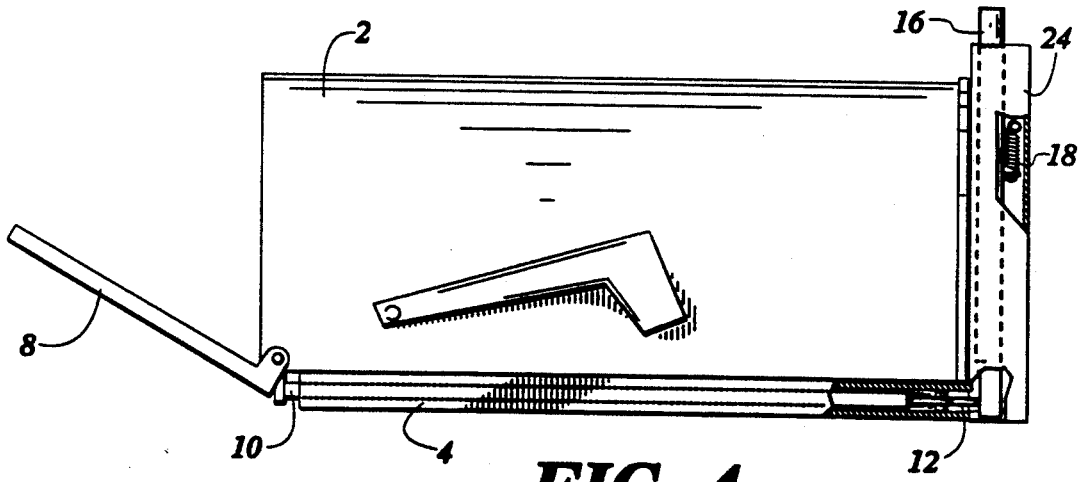
FIG. 4 is substantially the same view as FIG. 3, showing the door of the mailbox as pivoted downward to actuate the device.

As the door 8 of the mailbox is pivoted in a downward fashion, the edge of the mailbox door strikes the lever 12, as is shown in FIG. 4. This force on the lever causes the lever to be displaced and to slide within the platform, and to strike the trigger. The force of the lever upon the trigger causes the trigger to pivot away from the signal rod 16. The bottom surface of the signal rod is spring biased 18, and as the trigger pivots away from the signal rod, the signal rod is released and is displaced upwardly by the spring.

When the mailbox door is closed, pressure upon the trigger from the lever is removed. The trigger, by means of spring biasing 20, returns to its initial position, and pushes the lever by spring biasing 20 back to its initial position. By manual means, the signal rod may then be pushed downwardly until the slot 22 on the signal rod engages the trigger 12. The trigger will now hold the signal rod in place, until the action of the mailbox door and lever pivot the trigger away from the signal rod, allowing the release of the signal rod.

The lower edge of the signal rod may be bevelled to facilitate the engagement of the trigger with the slot in the signal rod as the signal rod is pushed downwardly to reset the signal rod.

Figure 3:
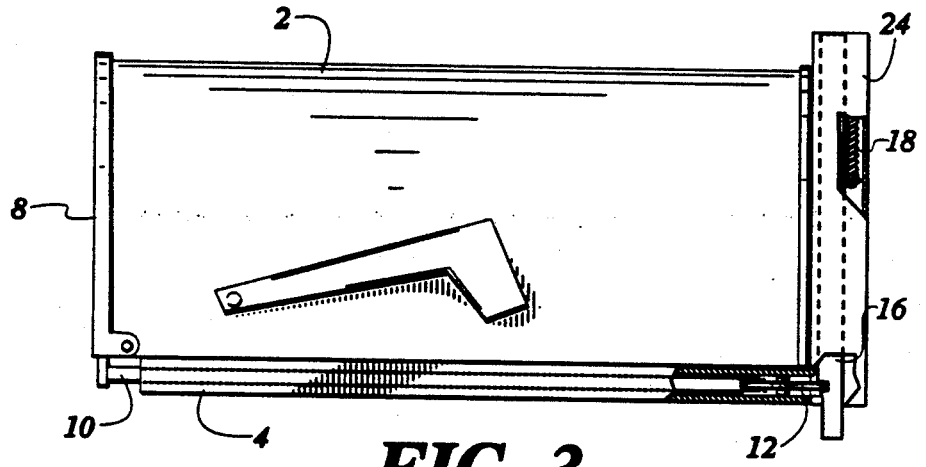
FIG. 3 is a side elevation of the mailbox signaling device which is partially sectioned to show the operation of the mechanism.

The signal rod may be located within a housing 24. It is desirable to paint or form the top edge of the signal rod to present a bright color, with the housing presenting a contrasting color. In the preferred embodiment, as the signal rod is pushed downward to its position as shown in FIG. 3, it is hidden within the housing. As it is released to the position shown in FIG. 4, the contrasting color of the signal rod, which could be a bright orange or red against a white housing, will make the signal rod visible.

In use, the signal rod will be positioned as shown in FIG. 3. When the mailbox is opened by the postal worker, the device is actuated, causing the signal rod to be visible as shown in FIG. 4. The device now indicates that mail has been placed within the mailbox by the postal worker, and the mail may then be retrieved by opening the mailbox door. After the mailbox door is closed, and the mail is retrieved, the signal rod may be pushed downward to engage the slot with the trigger, indicating that the mailbox is empty.

The amount of travel of the signal rod is controlled by the spring used for the spring biasing means. It is desirable that the travel of the signal rod be sufficient to reveal a sufficient portion of the signal rod to make it adequately visible from a significant distance While it is not imperative that the signal rod be placed within a housing, it is preferred that a housing be used so that the device may be removed from sight when the device is in the set, or armed, position.

The device may be made of durable materials which will allow the device to withstand the weather. The device is designed so that it will continue to operate after many years of exposure to weather, and it is not temperature or moisture sensitive. The device could be used with any mailbox whereby the action of the door opening is capable of depressing a lever so as to actuate the trigger and signal rod.

What is claimed is:

1. A mailbox signaling device, comprising:

(a) a platform on which a mailbox is mounted;

(b) a lever which is slidably located within said platform and which is displaced by a door of said mailbox as said door contacts said lever upon movement of said door;

(c) a trigger which is pivotally mounted to said platform by a pivot at a pivot point of said trigger, said trigger having a first end extending from said pivot point and having a second end which extends in an opposite direction from said pivot point, wherein, in use, said lever contacts and displaces said first end upon displacement of said lever, causing said trigger to pivot; and (d) a signal rod having a slot formed therein which engages said second end of said trigger so that said signal rod is held in position by said trigger, whereupon said second end of said trigger is disengaged from said slot in said rod as said trigger pivots, releasing said signal rod from engagement with said trigger.

2. A mailbox signaling device as described in claim 1, wherein said trigger is spring biased, and wherein, in use, said first end of said trigger displaces said lever as contact between said door of said mailbox and said lever is discontinued, and, wherein, in use, said second end of said trigger engages said slot of said signal rod as said signal rod is displaced to engage said slot with said trigger.

3. A mailbox signaling device as described in claim 1, wherein said signal rod is displaced by spring biasing as said signal rod is released from engagement with said trigger.

4. A mailbox signaling device as described in claim 1, wherein said signal rod is contained within a housing, and wherein said housing is mounted vertically on said platform.

5. A mailbox signaling device comprising:

(a) a platform on which a mailbox is mounted;

(b) a lever which is slidably located within said platform and which is displaced by a door of said mailbox as said door contacts said lever upon movement of said door;

(c) a trigger which is pivotally mounted to said platform by means of a pivot at a pivot point, wherein, in use, as said lever is displaced by contact with said door, said lever contacts a first end of said trigger, causing said trigger to pivot about said pivot point;

(d) a signal rod, having a slot formed therein which engages a second end of said trigger so as to be held in position by said trigger, wherein said second end of said trigger disengages said rod as said trigger is pivoted by said lever, releasing said signal rod;

(e) a housing which is mounted vertically on said platform and in which said signal rod is contained.

6. A mailbox signaling device as described in claim 5, wherein said trigger is spring biased, and wherein, in use, said first end of said trigger displaces said lever as contact between said door of said mailbox and said lever is discontinued, and, wherein, in use, said second end of said trigger engages said slot of said signal rod as said signal rod is displaced to engage said slot with said trigger.

7. A mailbox signaling device as described in claim 5, wherein said signal rod is displaced by spring biasing as said signal rod is released from engagement with said trigger.

* * * * *